US011582561B1

(12) United States Patent
Mayo et al.

(10) Patent No.: US 11,582,561 B1
(45) Date of Patent: Feb. 14, 2023

(54) SLOTTED THERMOPHONE

(71) Applicant: The United States of America as represented by the Secretary of the Navy, Newport, RI (US)

(72) Inventors: Nathanael K. Mayo, Bristol, RI (US); Stephen C. Butler, Portsmouth, RI (US)

( * ) Notice: Subject to any disclaimer, the term of this patent is extended or adjusted under 35 U.S.C. 154(b) by 179 days.

(21) Appl. No.: 17/322,951

(22) Filed: May 18, 2021

(51) Int. Cl.
*H04R 23/00* (2006.01)
*H04R 1/44* (2006.01)

(52) U.S. Cl.
CPC ..... *H04R 23/002* (2013.01); *H04R 1/44* (2013.01)

(58) Field of Classification Search
CPC .. H04S 2420/01; H04S 7/303; H04S 2400/01; H04S 7/305; H04S 7/302; G10K 15/08; G10K 15/02
USPC ..... 381/63, 61; 84/630; 700/94
See application file for complete search history.

(56) References Cited

U.S. PATENT DOCUMENTS 5,369,625 A * 11/1994 Gabrielson ..... H04R 23/00 367/141
2015/0208175 A1* 7/2015 Pinkerton ..... H04R 1/26 381/165

* cited by examiner

*Primary Examiner* — Norman Yu
(74) *Attorney, Agent, or Firm* — James M. Kasischke; Michael P. Stanley

(57) ABSTRACT

A thermophone includes an inner core and an outer shell coaxial with the inner core. The inner core and outer shell enclose a volume filled with gas. A pair of posts extend radially from the inner core to the outer shell and extend longitudinally between the inner core and the outer shell. At least one longitudinal slot is formed along the outer shell and a fluid seal covers the slot. A thermoacoustic active element is disposed in the volume and heated by modulated current to generate alternating pressure on the outer shell and produce acoustic signals.

17 Claims, 8 Drawing Sheets

SLOTTED THERMOPHONE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The invention relates to thermophones and thermoacoustic sound generators for use in underwater systems.

(2) Description of the Related Art

Thermophones are devices which generate sound using heat that is supplied to an active element or filament via an alternating electric current. By utilizing Joule heating of an active element, which has a low heat capacity, thermal rarefaction and contraction occurs within a small volume of gas immediately surrounding the filament producing a pressure wave. Thermophones are known for producing a wide frequency range of sound; however, thermophones have not been able to keep up with the much higher efficiencies of conventional acoustic sources such as electrodynamic loudspeakers and piezoelectric ceramics.

Carbon nanotubes have recently been utilized for thermoacoustic applications. Carbon nanotubes (CNTs) were researched in a 1991 paper by Suimo Iijima. S. Iijima, "Helical microtubules of graphitic carbon," *Nature*, vol. 354, pp. 56-58, 1991. CNTs are tiny fibrils of carbon roughly between 1 nm and 100 nm in diameter and individual lengths of up to centimeters. By 2005, development of carbon nanotubes was well underway when a group from the University of Texas at Dallas (UTD) created a method for producing CNT vertical arrays or 'forests' which could be spun into fibers or drawn out horizontally into thin sheets. See M. Zhang, S. Fang, A. A. Zakhidov, S. B. Lee, A. E. Aliev, C. D. Williams, K. R. Atkinson and R. H. Baughman, "Strong, Transparent, Multifunctional, Carbon Nanotube Sheets," Science, vol. 309, no. 5738, pp. 1215-1219, 2005.

These carbon nanotubes sheets have been used as a thermophone active element and resulted in demonstration of a flexible thermoacoustic device. See L. Xiao, Z. Chen, C. Feng, L. Liu, Z.-Q. Bai, Y. Wang, L. Qian, Y. Zhang, Q. Li, K. Jiang and S. Fan, "Flexible, Stretchable, Transparent Carbon Nanotube Thin Film Loudspeakers," *Nano Letters*, vol. 8, no. 12, pp. 4539-4545, 2008. Aliev et al. at the University of Texas at Dallas submerged CNT sheets underwater for thermoacoustic sound generation as well as for studies of the 'mirage effect'. The CNT sheet was encapsulated to protect it as disclosed in Aliev et al., "Encapsulated thermoacoustic projector based on freestanding carbon nanotube film," U.S. Patent Publication No. 2016/0037267. In these encapsulated devices, a significant amount of effort is made to limit contact between the CNT sheet and the encapsulation media. In most cases, the carbon nanotube sheet is suspended between two plates or membranes so as not to make contact and leak thermal energy. It is also known to use a support material such as cloth or lightweight fiberglass mesh to improve robustness of the CNT sheet.

Tests on CNT thermophones in air have shown a linear dependence of acoustic pressure on frequency and power. Experiments have demonstrated that encapsulated thermophones exhibit resonant behavior which is determined largely by the properties of the encapsulation media. Utilizing thinner, lightweight membranes allows for broader resonances which behave more like an open system, while thicker, heavier plates create a more highly resonant system. Submerging these encapsulated devices causes their resonance frequencies to shift, primarily due to mass loading on the surface of the encapsulation media. An unintended consequence of submerging these gas-filled encapsulated structures is that the extra pressure at depth will cause the encapsulation media to bow inward. To remedy this, a pressure compensation system must be attached and accompany the thermophone.

Flextensional transducers have evolved from, for example, U.S. Pat. No. 2,064,911 to Hayes et al. and U.S. Pat. No. 3,274,537 to Toulis. These devices operate by amplifying extensional strain in a piezoelectric or magnetostrictive element which acts upon a curved shell. Conceptually, the geometric configuration of these devices utilizes a lever arm to convert the large extensional force of the active material to a smaller force with a greater displacement in the vibrating shell.

Other conventional flexural transducers designs operate in which the active material is excited in a bending mode in which the extensional motion is limited. One example of such a device is the split cylinder or slotted cylinder transducer. See, for example, U.S. Pat. Nos. 4,220,877 and 4,651,044 to Kompanek. The bending modes in a slotted cylinder are akin to those of a tuning fork and the design is well known for its low frequency sound generation and compact size. Various iterations and improvements to the slotted cylinder design have been made over the years, as exemplified in U.S. Pat. No. 5,103,130 to Rolt et al; U.S. Pat. No. 5,229,978 to Flanagan et al.; U.S. Pat. No. 5,450,373 to Kupiszewski et al.; U.S. Pat. No. 4,774,427 to Plambeck; and U.S. Pat. No. 6,690,621 to Porzio.

In conventional transducer design, the active material is inherently part of the mechanical system that makes up the device. To maintain a given sound pressure level, a transducer must be able to traverse a larger displacement the lower the frequency. Piezoelectrics are generally stiff materials with a low tensile strain limit and, therefore, are limited in their ability to perform at low frequencies unless relatively large amounts of material used. The common solution to this is to amplify the piezoelectric displacement by using a lever arm such as in flextensional devices.

SUMMARY OF THE INVENTION

In a first aspect, a thermophone includes an inner core having and an outer shell having a hollow defined therein. A longitudinal slot is formed in the outer shell along the entire length thereof. The outer shell is coaxial with the inner core. The inner core and outer shell enclose a volume filled with gas. At least one post extends radially from the inner core to the outer shell. Each post is fixed to the inner core and the outer shell. A fluid seal joined to the outer shell covers the longitudinal slot. A thermoacoustic active element is disposed in the volume between the outer shell and the core.

A pair of end caps seal the combined inner core and outer shell to further define the volume. A support structure may be joined to the inner core and disposed in the volume. The thermoacoustic active element may be supported on the support structure. The support structure may suspend the thermoacoustic active element in the volume such that the active element does not contact the inner core and the outer shell.

The inner core may be hollow and define a second volume having a first end and a second end. One of the end caps may be joined to the inner core and enclose the first end of the second volume. An elastic bladder may be disposed inside the second volume. The bladder may have an open end that is fixed to the inner core at the second end of the second volume. The inner core includes at least one gas port formed therein that connects the volume and the second volume for equalizing pressure between the volume and the second volume. A modulated electric current source may be connected to the thermoacoustic active element.

In another aspect, an unmanned underwater vehicle includes a source of modulated current and a thermophone having a thermoacoustic active element. The thermoacoustic active element is connected to the source of modulated current.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

A thermophone as shown herein allows a thermoacoustically driven transducer. Unlike piezoelectric transducers, the mechanical response of a thermoacoustic device is determined by the properties of the housing and gas used, both of which are far more compliant than ceramics such as piezoelectric elements. As a result, the disclosed thermophones have a compact form factor while operating at a lower resonance frequency than many conventional transducers. The relative simplicity of the design, small amount of material required, and reduced cost of the active material provide a very low-cost floor potential for these thermophone projectors.

The thermophones may include an inner core. The inner core may be solid or may be hollow. If hollow, the inner core defines an interior volume. A hollow outer shell surrounds the inner core. The inner core and outer shell define a volume therebetween, known as the active chamber. The active chamber is filled with a gas, such as a relatively inert gas. Examples of suitable gases are the noble gases, nitrogen and sulfur hexafluoride. The outer shell is fixed to the inner core by one or more posts. In the shell, there is at least one longitudinal slot from one end to the other. On either side of the slot, there are a pair of outer shell edges with "free" boundary conditions that are less constrained as compared to "clamped" or "simply supported" edges.

The transverse cross-sections of the inner core and outer shell may have a variety of shapes, such as circular, elliptic, parabolic, hyperbolic, triangular, rectangular, etc. It is preferred to minimize the volume of the active chamber between the inner core and the outer shell. Therefore, the transverse cross-sections of the inner core and outer shell are the same shape or substantially the same shape. Small variations in shape (such as a taper in thickness, for example) between the transverse cross-sections of the inner core and outer shell may be justified for reasons such as tuning resonance frequency, increasing ease of assembly or increasing strength at high stress concentration areas.

Figure 1A:
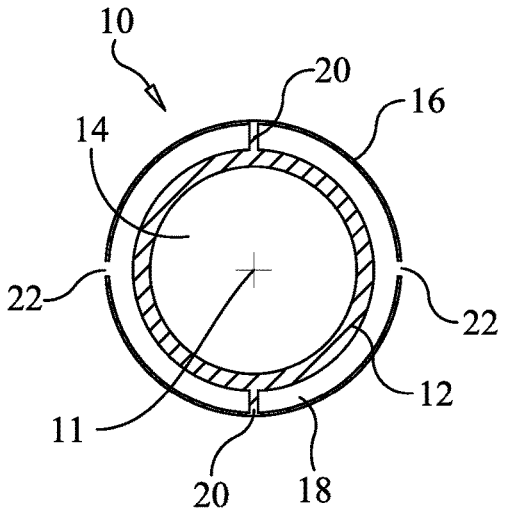
FIG. 1A is a schematic transverse cross-sectional view of an embodiment of a thermophone.

FIG. 1A is a schematic transverse cross-sectional view of an embodiment of a thermophone 10 formed as a pair of hollow concentric cylinders having a common axis 11. The inner cylinder is the inner core 12, and the outer cylinder is the outer shell 16. Core 12 defines an interior volume 14. Shell 16 is fixed to core 12 with a pair of posts 20. At least one longitudinal slot 22 is formed in shell 16. The volume defined between shell 16 and core 12 is known as the active chamber 18.

Figure 1B:
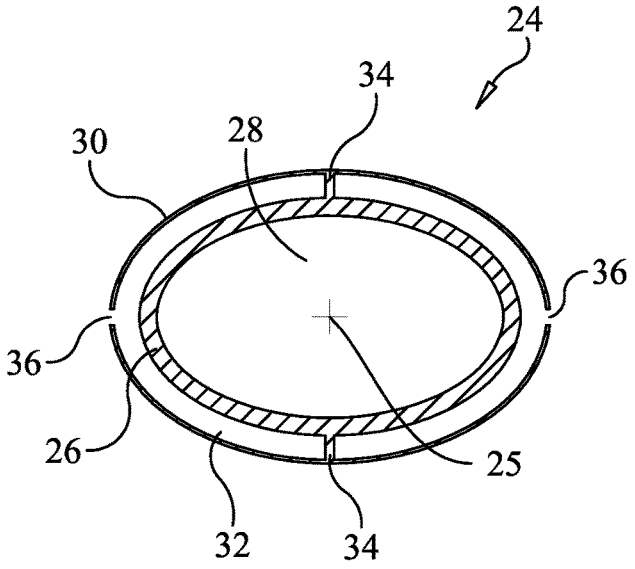
FIG. 1B is a schematic transverse cross-sectional view of an embodiment of a thermophone.

FIG. 1B is a schematic transverse cross-sectional view of an embodiment of a thermophone 24 including a pair of hollow concentric tubes with ellipsoidal cross-sections having a common axis at 25. The inner tube is the core 26 and the outer tube is the shell 30. Core 26 defines an interior volume 28. Shell 30 is fixed to core 26 with a pair of posts 34. Two slots 36 are formed in shell 30.

Figure 2:
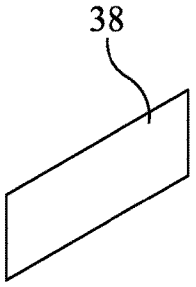
FIG. 2 is a schematic of a thermoacoustic active element.

A thermoacoustic active element 38 is shown schematically in FIG. 2 as a thin conductive sheet, such as a metal foil. The thermoacoustic active element 38 may reside anywhere within the active chambers 18, 32 of thermophones 10, 24. The material of active element 38 may be, for example, thin metal foil, thin conductive networks of metal or carbon nanotubes (CNT), metal or carbon sponges, graphene, carbon materials formed by pyrolysis (or a combination of such materials). The CNT may be single wall nanotube sheets or multiwall nanotube sheets. Alignment of nanotubes within the sheet is not critical. Individual CNT sheets are roughly 20 microns thick in air. Use of materials having a low heat capacity makes the thermoacoustic active element 38 responsive to rapid heating. The active element 38 may be positioned in the entire area of active chambers 18, 32 or specific portions. Element 38 may include a single element or multiple elements configured in series and/or parallel. Element 38 may use any form of electrical connection such as an interdigitated electrode structure to tune or modify the device's electrical impedance.

The thermophone active element 38 is electrically heated and exchanges this generated heat with the immediately surrounding gaseous environment within the active chambers 18, 32. The current to heat the active element 38 may be a modulated current, for example, alternating current or direct current with pulsed width modulation. The heated gas undergoes ideal gas expansion causing deflection of the shells 16, 30. The posts 20, 34 provide support to maintain the gap between the cores 12, 26 and their respective shells 16, 30.

Figure 3:
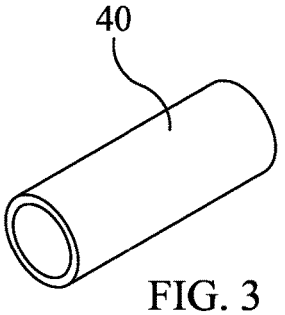
FIG. 3 is a schematic of a boot.

Slots 22, 36 in shells 16, 30 allow the ends of the shells to move without obstruction as a curved cantilever. In practice, open slots 22, 36 would provide a pathway for the expanding gas in the active chambers 18, 32 to escape without providing significant mechanical deflection of the shells. Therefore, slots 22, 36 are fluidly sealed with, for example, a boot or sleeve 40 (FIG. 3) made from rubber, urethane, or some other resilient material. In the case of using the sleeve 40 for the fluid seal, the sleeve encompasses the exterior of shells 16, 30. Whatever type of fluid seal is used, the seal is more compliant than shells 16, 30. Additionally, the fluid seal prevents the external aqueous environment from penetrating into active chambers 18, 32 and flooding thermophones 10, 24.

Figure 4A:
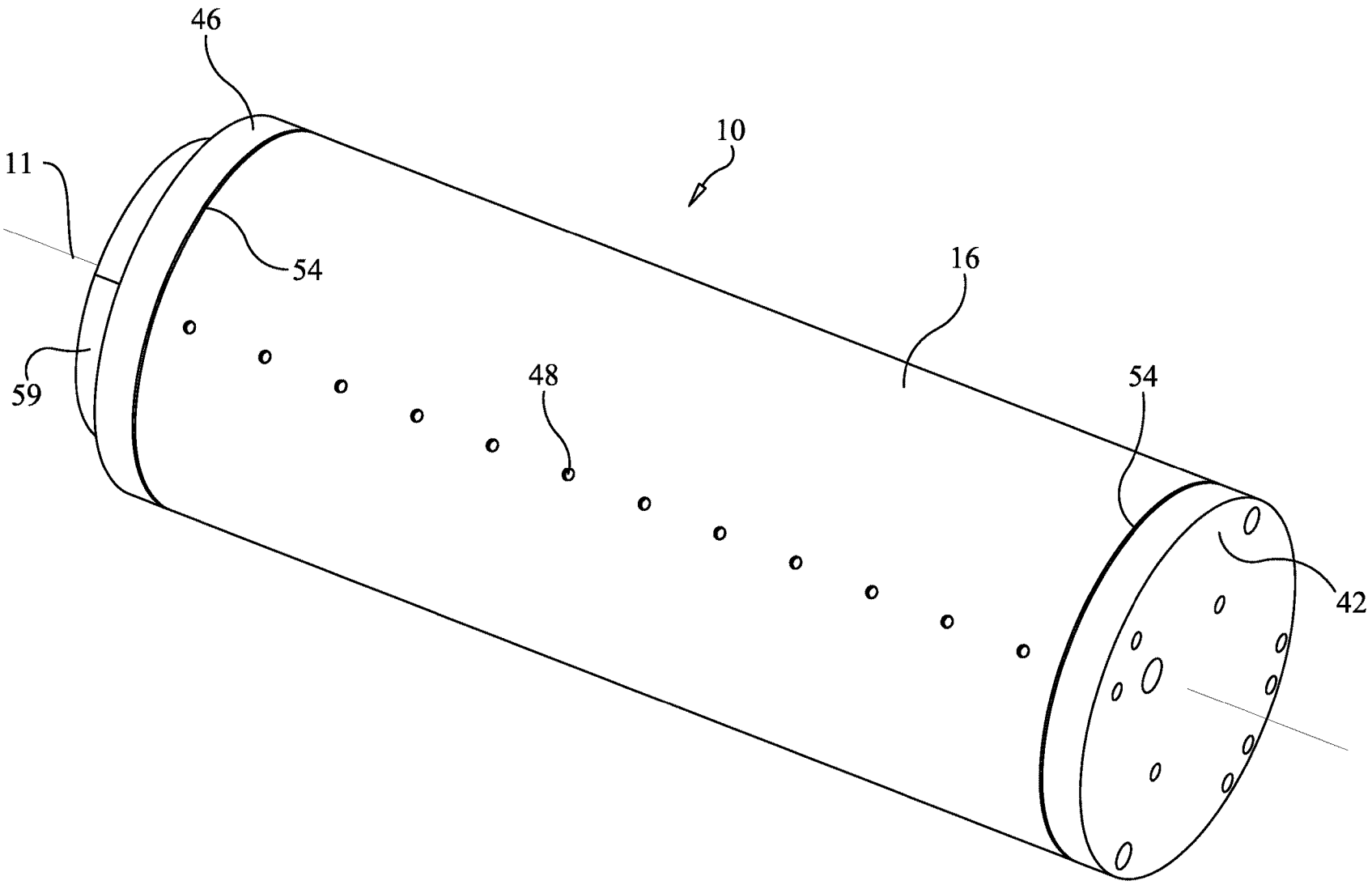
FIGS. 4A and 4B are perspective views of an embodiment of a thermophone.
Figure 4B:
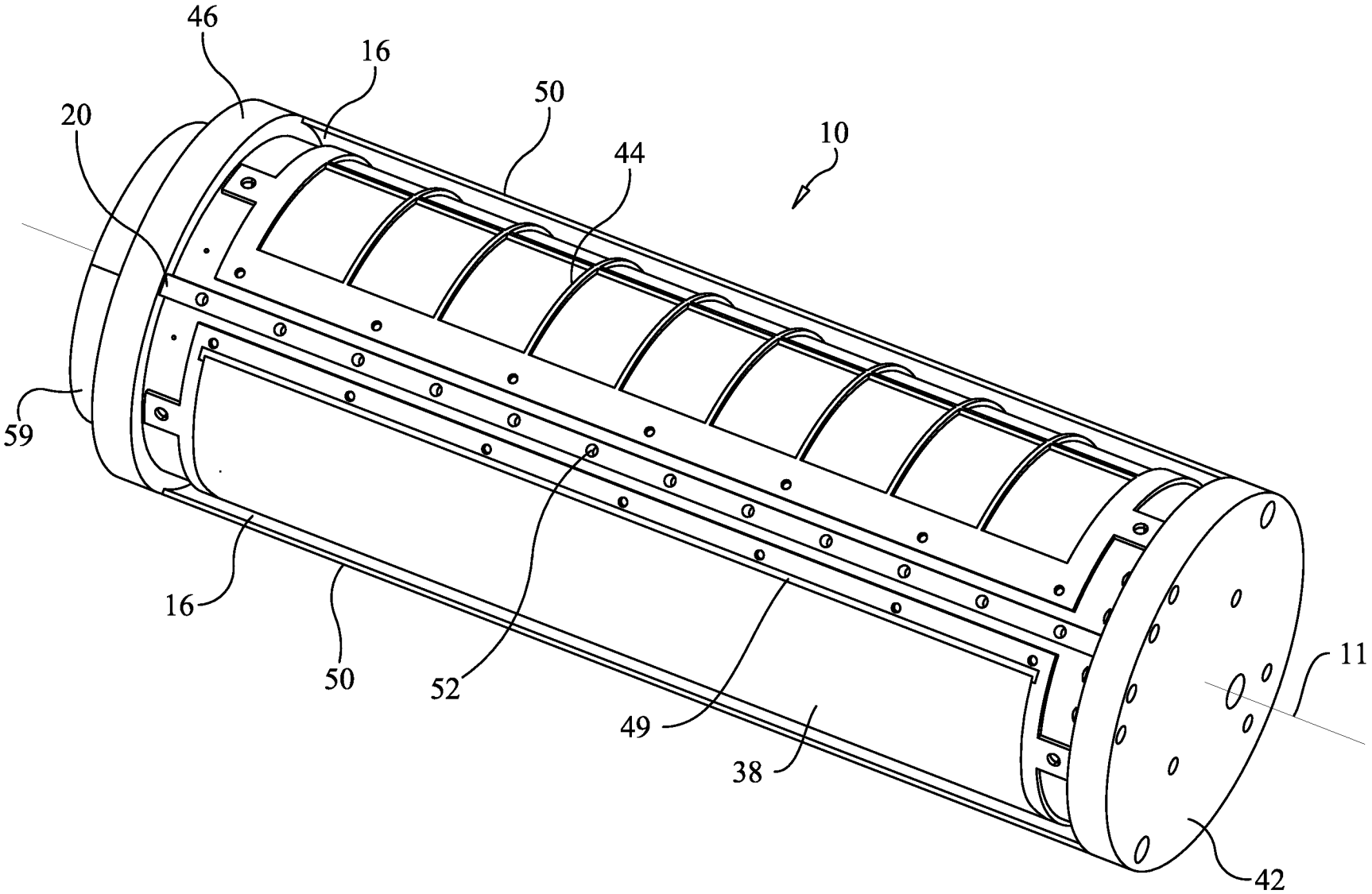

FIGS. 4A and 4B are perspective views of thermophone 10 shown in more detail. FIG. 4B is a view of FIG. 4A rotated 180 degrees about the axis 11 with part of shell 16 removed for visibility. Thermoacoustic device 38 is also removed on the upper portion to show the underlying structure. FIG. 4A shows the shell 16, closed end cap 42 and fastener openings 48. End cap 42 closes both the interior volume 14 and the active chamber 18 (FIGS. 1A and 1B). End ring 46 closes active chamber 18 but not interior volume 14 to thereby allow access to interior volume 14. Fastener openings 48 receive fasteners (not shown) that fix shell 16 to post 20 (see also FIG. 4D) and core 12. Half of shell 16 is removed in FIG. 4B to show a support structure 44. The lower portion of FIG. 4B shows the thermoacoustic active element 38 placed over support structure 44 and in contact with electrode 49 along the longitudinal edge of the thermoacoustic active element. Support structure 44 enables the thermoacoustic active element 38 to be suspended across electrodes 49 in the active chamber 18.

Shell 16 is fixed to post 20 via fasteners and openings 48 in shell 16 and openings 52 in post 20. Longitudinal slots 22 (FIG. 1A) are formed at edges 50 (FIG. 4B) where the two shell halves are placed close together but do not join each other, thereby leaving a gap that forms slots 22. One or more circumferential slots 54 (FIG. 4A) may also be formed between shell 16, end cap 42 and/or end ring 46. FIG. 4A does not show the fluid seal (such as sleeve 40, FIG. 3) that covers shell 16 and slots 22 or 54. The ends 42 and 46 and core 12 may be made of a single piece of metal or the ends 42 and 46 may be made separately from core 12. Core 12, end cap 42 and end ring 46, support structure 44, posts 20 and shell 16 may be made of metals, for example, aluminum or aluminum alloys.

Figure 4C:
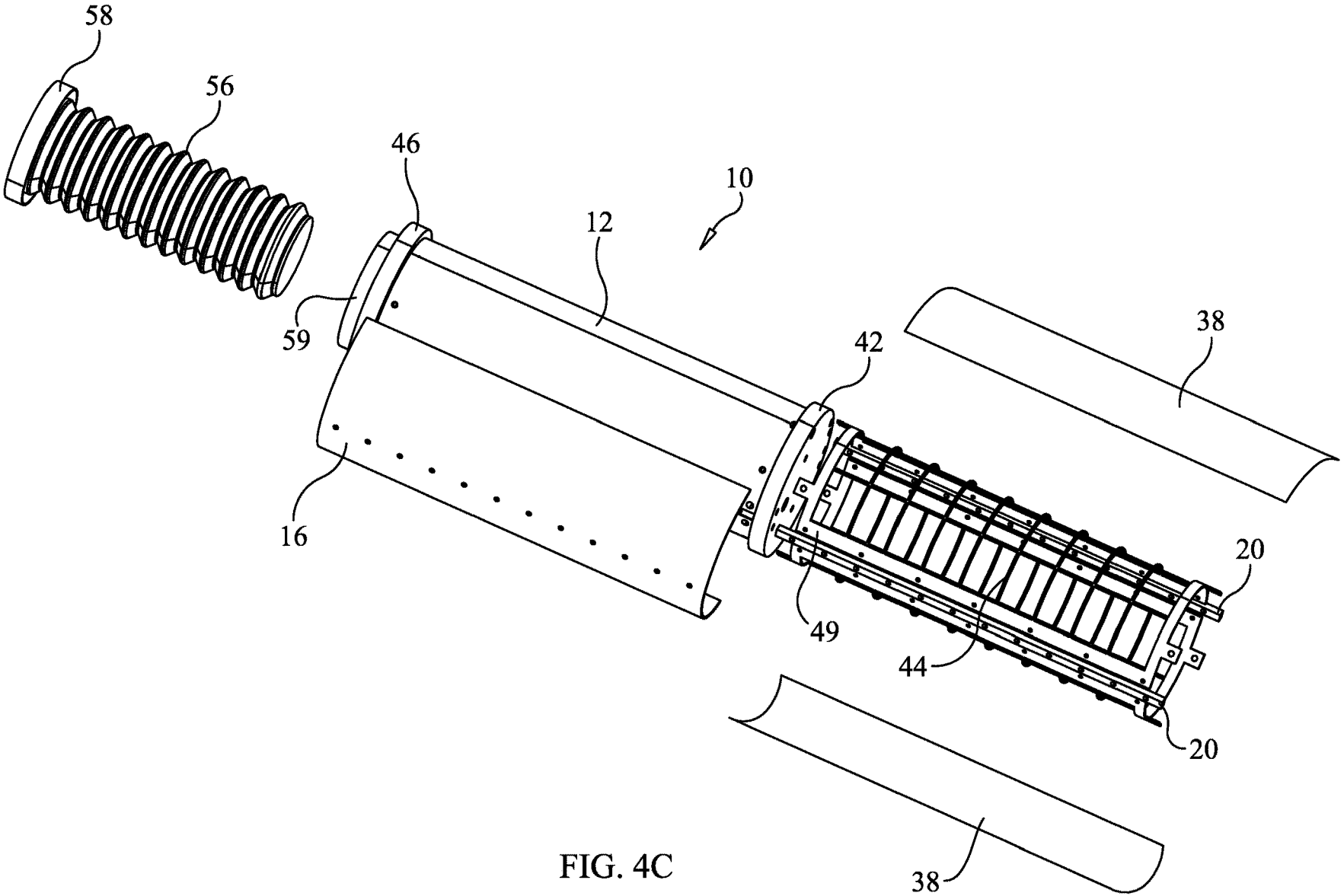
FIG. 4C is an exploded view of the thermophone of FIGS. 4A and 4B.
Figure 4D:
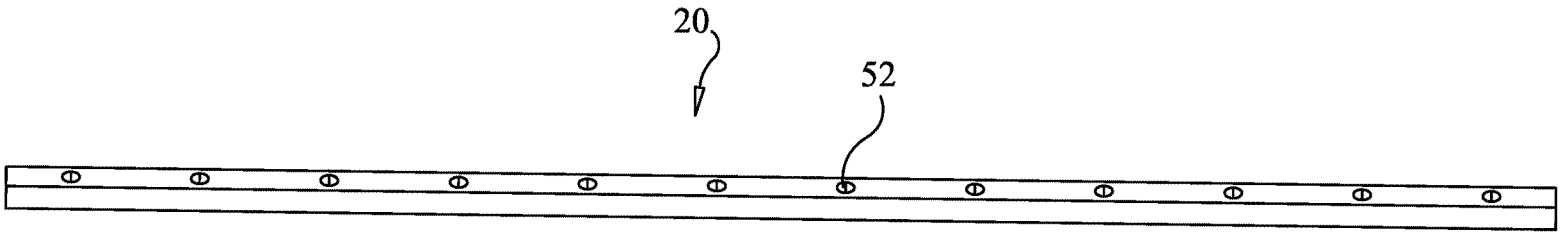
FIG. 4D is a perspective view of a post.

FIG. 4C is an exploded view of the thermophone 10 of FIGS. 4A and 4B. The thermoacoustic active element 38 is shown in FIG. 4C as two strips of curved metal foil that are supported by support structure 44 and extend between electrodes 49. Disposed in the interior volume 14 is a pressure bladder or bellows 56. As an alternative to bladder 56, the hollow interior volume 14 may be used to store power electronics and batteries (not shown), for example. The lip 58 of bladder 56 is attached by a retention ring, such as a ring clamp (not shown), around flange 59 at the end of core 12. The bladder 56 is fitted inside interior volume 14.

Figure 4E:
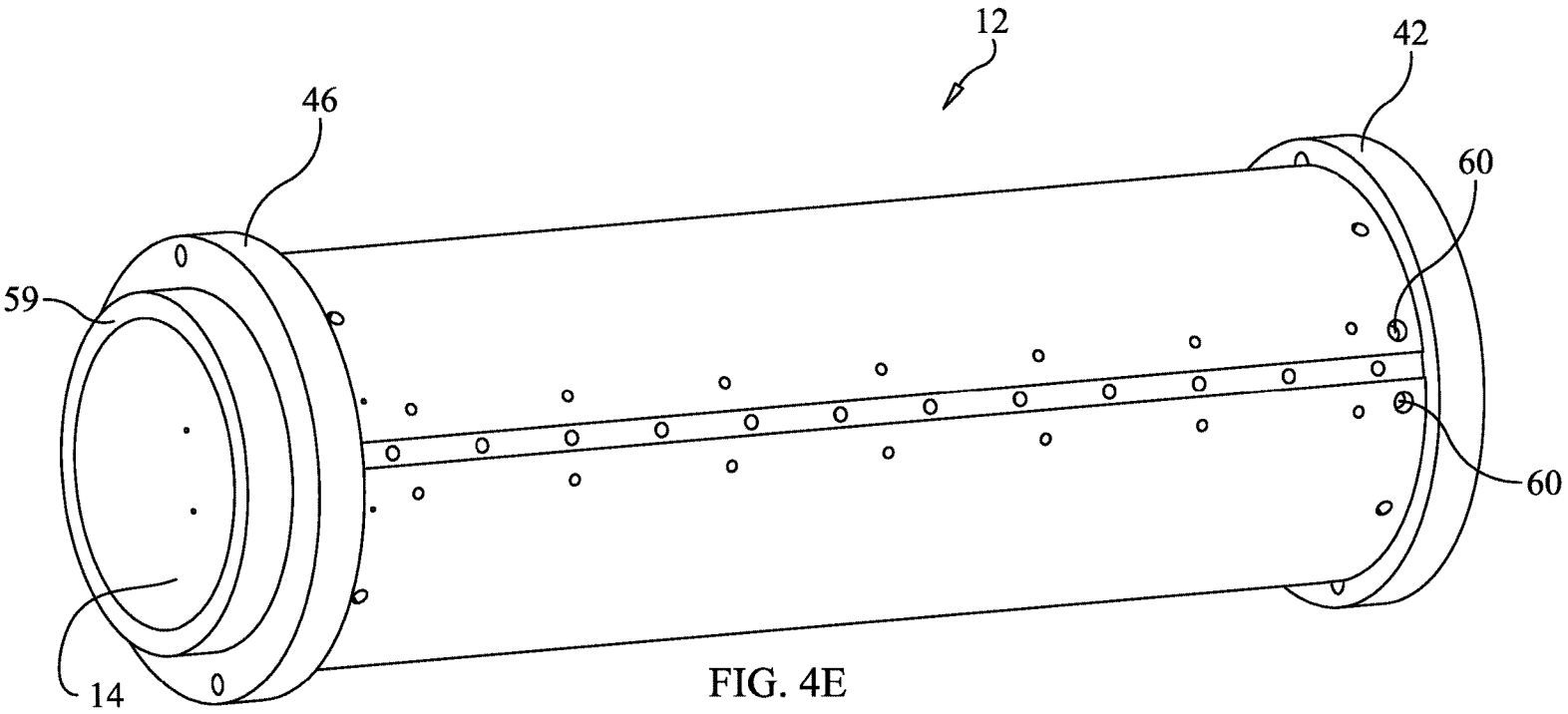
FIG. 4E is a perspective view of a core.

Referring to FIG. 4E, one or more gas ports 60 near closed end cap 42 allow control of the flow of gas from the interior volume 14 to the active chamber 18. Screw valves (not shown) may be inserted in openings 62 (FIG. 4F) in end cap 42 to control the size of the openings in ports 60. By this means, any additional external hydrostatic pressure causes the bladder 56 to extend further within the interior volume 14. Gas from volume 14 flows through ports 60 and slowly fills active chamber 18 and increases its internal pressure, thereby compensating the external hydrostatic pressure along the outside of the shell 16. The compliance of the bladder 56 should be greater than that provided by the shell 16. Otherwise, shell 16 will deflect to add pressure to the interior rather than the other way around.

Figure 5A:
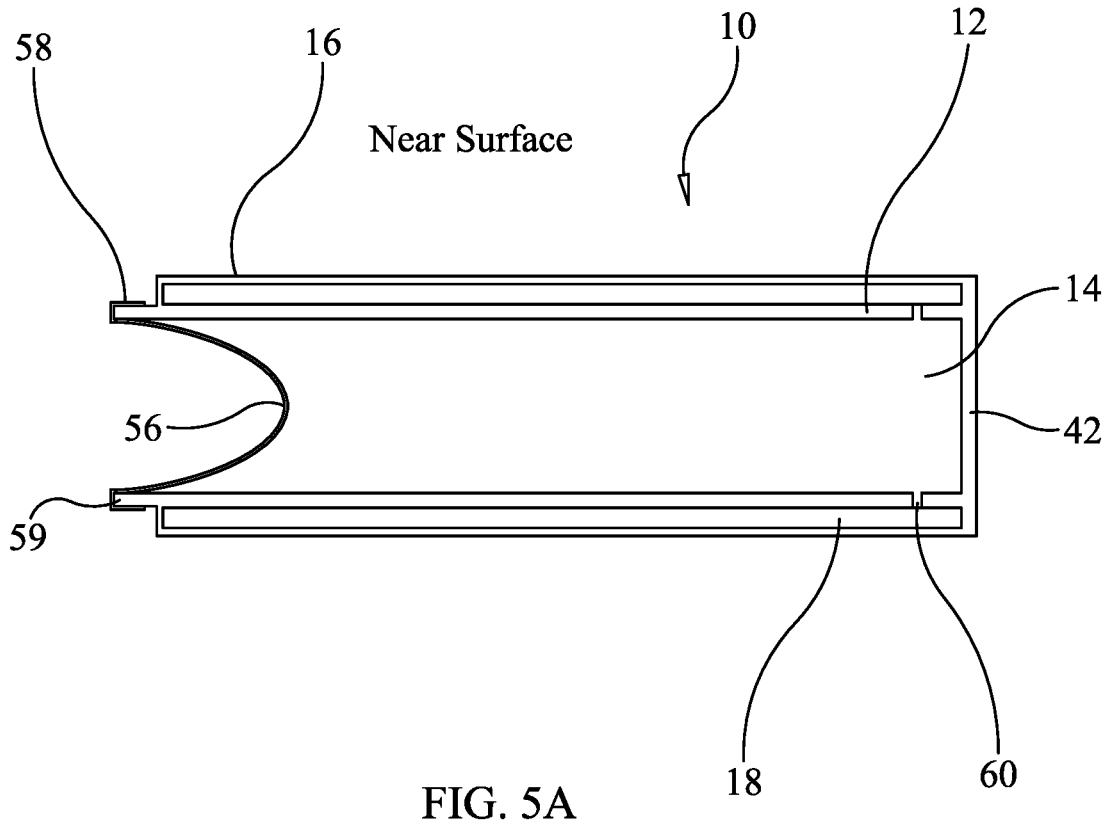
FIGS. 5A and 5B are schematics of longitudinal cross-sections of a thermophone illustrating passive pressure compensation in an underwater thermophone.
Figure 5B:
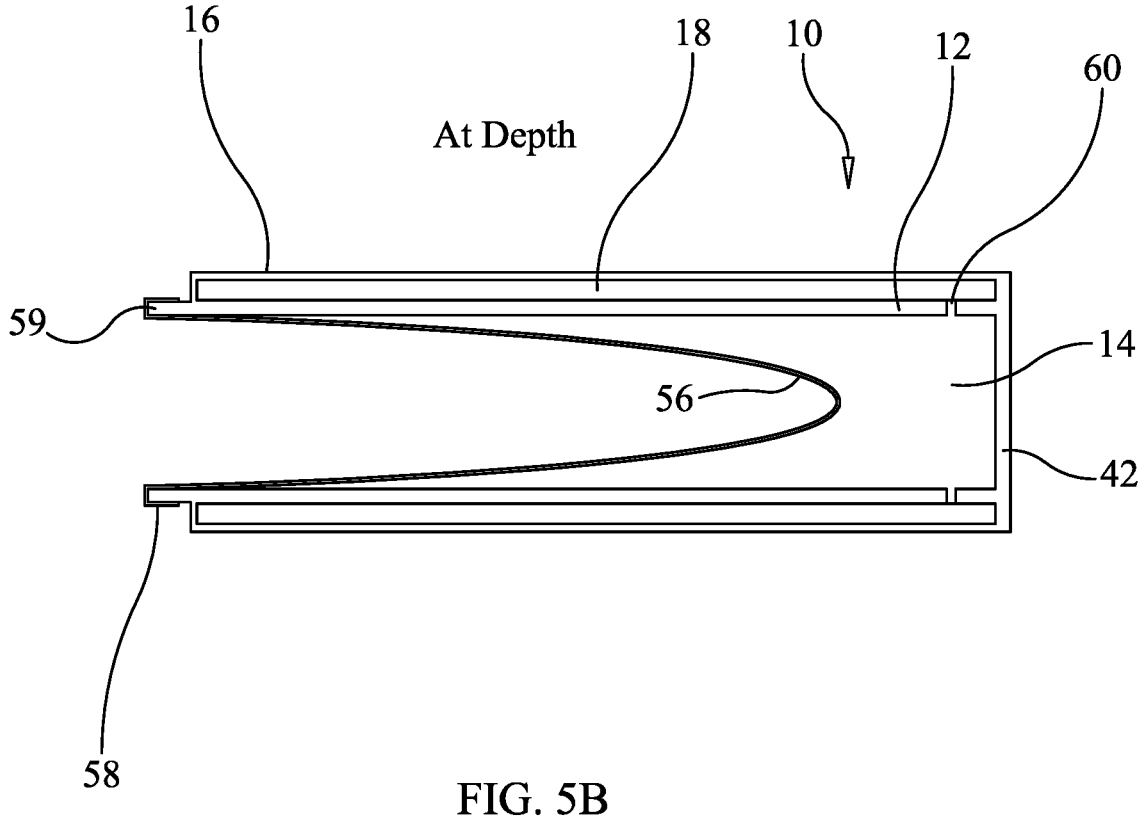

FIGS. 5A and 5B are schematics of lateral cross-sections of thermophone 10 that illustrate pressure compensation in underwater slotted cylinder thermophone 10. FIG. 5A depicts thermophone 10 when it is near the surface of the water and FIG. 5B depicts thermophone 10 at depth in the water. Elastic bladder 56 deforms under hydrostatic pressure, shrinks the volume of gas in the interior volume 14, and displaces a portion of the gas to the active chamber 18 via small ports 60 near the closed end cap 42 of the thermophone 10. The ports 60 through which gas flows from the interior volume 14 to the active chamber 18 should be made as small as possible so that they interfere minimally with the dynamic flow of gas in the active chamber 18, yet large enough to rapidly respond to hydrostatic pressure changes associated with descent of thermophone 10 in the water.

Figure 4F:
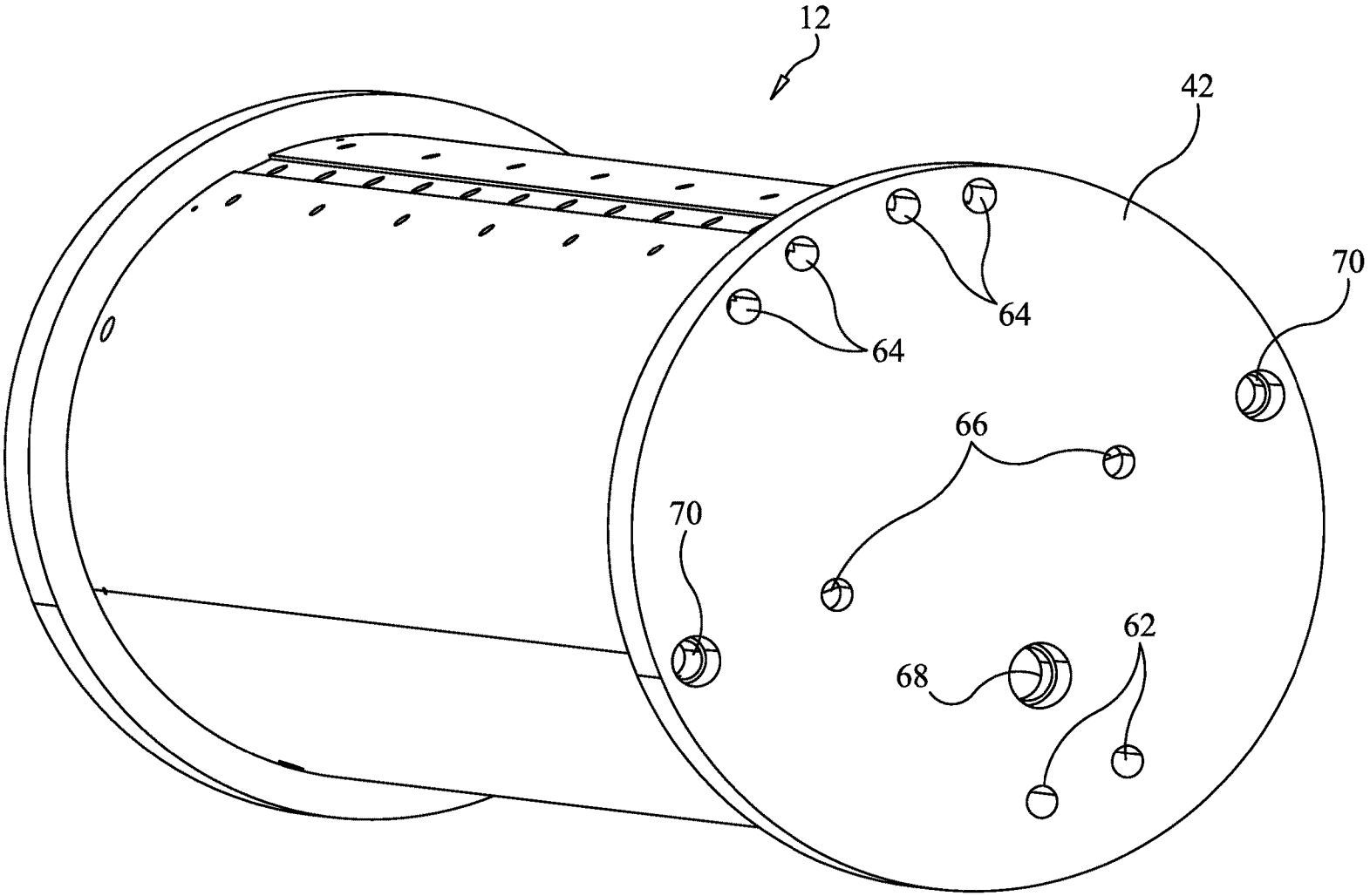
FIG. 4F is a perspective end view of the core of FIG. 4E.

Referring to FIG. 4F, other openings in end cap 42 include openings 64 for electrical connections to thermoacoustic active element 38, openings 66 for attaching a handle, openings 70 for gas exit from active chamber 18 (plugged after chamber 18 is filled with inert gas) and an opening 68 for filling interior volume 14 with gas (plugged after filling).

Figure 6:
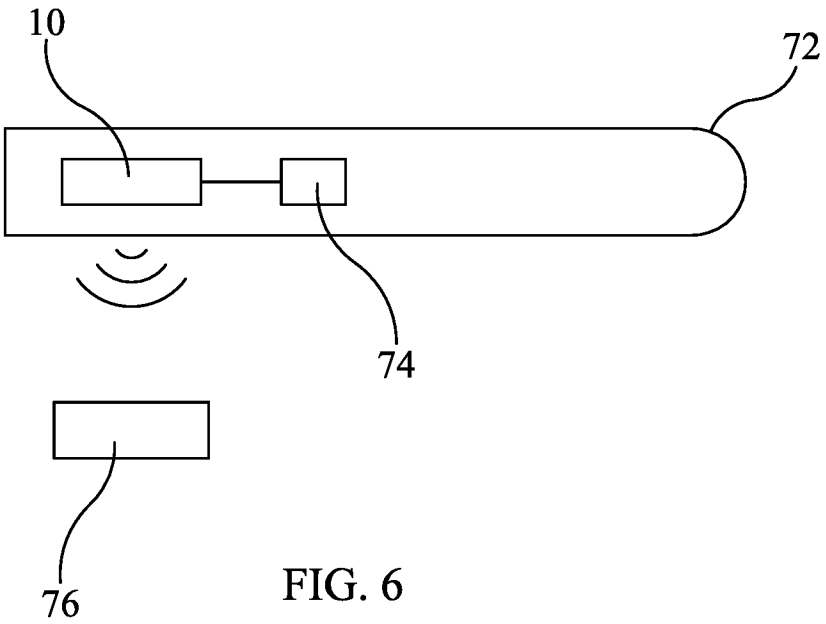
FIG. 6 is a schematic of an unmanned underwater vehicle (UUV).

FIG. 6 is a schematic of an unmanned underwater vehicle (UUV) 72 containing thermophone 10 connected to a source of alternating current 74. Thermophone 10 may be used, for example, to generate acoustic signals that are received by a hydrophone 76.

A number of variations to thermophone 10 may be made. As with conventional slotted cylinder designs, various changes to the shell could be made, such as applying a boot or sleeve with a compliant loop within the cylinder's slot 22, similar to the boot loop seal described in U.S. Pat. No. 5,103,130 by Rolt et al. Shell taper may be used to reinforce areas of high stress concentration such as where the shell 16 is attached to the post 20. The core 12, post 20, and shell 16 may be made from a single solid piece or from multiple pieces joined by screws, fasteners, or welding. The core and shell may have a variety of different shaped transverse cross-sections, so long as the post provides some separation thereby creating the active chamber. Additional slots or splits may be made in the shell along the circumference, perpendicular to the slots 22 along its length, as a means for decoupling portions of the shell and controlling the vibrational mode shape.

A variety of materials may be used for any of the components for the purpose of tuning resonance, thermal dissipation, electrical properties, or depth capability. Alternate variants may have any amount of thermoacoustic active material coverage or positioning of the active material within the active chamber. Variants may include open rings or closed end caps, end caps which are structurally part of the core or shell, or removable end caps. The interior volume may be used to house any component, part or whole, comprising electronic circuitry, power storage, or pressure compensation mechanism. An internalized pressure compensation system does not need to be asymmetrical as shown in thermophone 10 and may be made symmetric (i.e., two bladders on opposite sides expanding under pressure towards the center of the unit) to alleviate torque due to asymmetric buoyancy.

The thermoacoustic active material may be placed anywhere within the active chamber for any number of reasons which may optimize fluid flow within the chamber, mechanical robustness of the active element, or thermal dissipation. In most cases, it is beneficial to suspend the active material to maximize its contact with the internal gas and to minimize direct thermal dissipation from the active material into the core or shell. As such, physical contact with the active material is typically only desired to improve the mechanical reliability of the system as it comes at the cost of a lower transduction efficiency.

The details, materials, steps and arrangement of parts have been described and illustrated to explain the nature of the invention. It will be understood that many changes in the details, materials, steps and arrangement of parts may be made by those skilled in the art, within the principle and scope of the invention, as expressed in the appended claims and equivalents thereof.

What is claimed is:

1. A thermophone, comprising:

an inner core having an axis;

an outer shell having a hollow defined therein and a longitudinal slot formed in the outer shell along the entire length thereof, said outer shell being coaxial with the inner core, the inner core and outer shell enclosing a volume filled with gas;

at least one post extending radially from the inner core to the outer shell, each post being fixed to the inner core and the outer shell;

a fluid seal joined to the outer shell to cover the at least one longitudinal slot; and a thermoacoustic active element disposed in the volume between the outer shell and the inner core.

2. The apparatus of claim 1, wherein the inner core and outer shell have transverse cross-sections of substantially a same shape.

3. The apparatus of claim 2, further comprising a pair of end caps that seal the combined inner core and outer shell to further define the volume.

4. The apparatus of claim 3, wherein the at least one post includes more than two posts positioned around a perimeter of the inner core.

5. The apparatus of claim 3, further comprising a support structure joined to the inner core and disposed in the volume, the thermoacoustic active element being supported on the support structure.

6. The apparatus of claim 5, wherein the support structure suspends the thermoacoustic active element in the volume such that the active element does not contact the inner core and the outer shell.

7. The apparatus of claim 5, wherein the inner core is hollow and defines a second volume having a first end and a second end.

8. The apparatus of claim 7, wherein one of the end caps is joined to the inner core and encloses the first end of the second volume.

9. The apparatus of claim 8, further comprising an elastic bladder disposed inside the second volume, the bladder having an open end that is fixed to the inner core at the second end of the second volume.

10. The apparatus of claim 9, wherein the inner core has at least one gas port formed therein that connects the volume and the second volume for equalizing pressure between the volume and the second volume.

11. The apparatus of claim 10, further comprising an inert gas in the volume and the second volume.

12. The apparatus of claim 10, further comprising a modulated current source connected to the thermoacoustic active element.

13. A thermophone comprising:

an inner core enclosing a first volume and having at least one gas port therein in communication between the first volume and an outer surface of the inner core;

an outer shell coaxial with the inner core, the inner core and outer shell enclosing a second volume filled with gas, the outer shell having at least one longitudinal slot formed therein along an entire length of the outer shell;

at least one post extending radially from the inner core to the outer shell and extending longitudinally along a length of the outer shell, the post being fixed to the inner core and the outer shell;

a fluid seal joined to the outer shell that covers the at least one longitudinal slot;

a thermoacoustic active element disposed in the second volume;

a first end cap that is joined to the inner core and the outer shell to close one end of the combined inner core and outer shell second volume;

a second end cap joined to the inner core to close one end of the first volume;

a support structure joined to support the thermoacoustic active element in the second volume; and an elastic bladder disposed inside the inner core, the bladder having an open end that is located at one end of the inner core.

14. The apparatus of claim 13, wherein the inner core and outer shell have transverse cross-sections of substantially a same shape.

15. The apparatus of claim 13, wherein the at least one post includes at least two posts positioned around a perimeter of the inner core.

16. The apparatus of claim 13, wherein the support structure suspends the thermoacoustic active element in the second volume such that the thermoacoustic element does not contact one of the inner core and the outer shell.

17. An unmanned water vehicle comprising:

a source of modulated current; and a thermophone comprising:

an inner core having an axis;

an outer shell having a hollow defined therein and a longitudinal slot formed in the outer shell along the entire length thereof, said outer shell being coaxial with the inner core, the inner core and outer shell enclosing a volume filled with gas;

at least one post extending radially from the inner core to the outer shell, each post being fixed to the inner core and the outer shell;

a fluid seal joined to the outer shell to cover the at least one longitudinal slot; and a thermoacoustic active element disposed in the volume between the outer shell and the inner core wherein the thermoacoustic active element is connected to the source of modulated current.

* * * * *